US012404671B2

(12) United States Patent
Fisher

(10) Patent No.: US 12,404,671 B2
(45) Date of Patent: Sep. 2, 2025

(54) PARTITION PANEL SYSTEM

(71) Applicant: Nathan Fisher, Monsey, NY (US)

(72) Inventor: Nathan Fisher, Monsey, NY (US)

(73) Assignee: Nathan Fisher, Monsey, NY (US)

( * ) Notice: Subject to any disclaimer, the term of this patent is extended or adjusted under 35 U.S.C. 154(b) by 351 days.

(21) Appl. No.: 18/127,536

(22) Filed: Mar. 28, 2023

(65) Prior Publication Data

US 2024/0328152 A1 Oct. 3, 2024

(51) Int. Cl.

| | |
|---|---|
| ***E04B 2/74*** | (2006.01) |
| ***E04B 1/38*** | (2006.01) |
| ***E04B 1/61*** | (2006.01) |
| ***E04B 2/78*** | (2006.01) |

(52) U.S. Cl.

CPC ..... *E04B 2/7425* (2013.01); *E04B 1/388* (2023.08); *E04B 1/6179* (2013.01); *E04B 2/7409* (2013.01); *E04B 2/7427* (2013.01); *E04B 2002/7461* (2013.01); *E04B 2/7809* (2013.01)

(58) Field of Classification Search

CPC ..... E04B 2/7425; E04B 1/388; E04B 1/6179; E04B 2/7409; E04B 2/7427; E04B 2/7809; E04B 2002/7461

See application file for complete search history.

(56) References Cited

U.S. PATENT DOCUMENTS

| | | | | |
|---|---|---|---|---|
| 4,402,167 | A * | 9/1983 | Denucci | E04B 1/6183 52/562 |
| 6,006,480 | A * | 12/1999 | Rook | B32B 13/045 52/762 |
| 6,235,367 | B1 * | 5/2001 | Holmes | E04B 1/14 52/309.7 |
| 9,469,983 | B2 * | 10/2016 | Bruce | E04B 1/388 |
| 10,246,873 | B1 * | 4/2019 | Costanza | B32B 21/047 |
| 10,287,770 | B2 * | 5/2019 | Hodson | E04C 2/2885 |
| 11,486,132 | B2 * | 11/2022 | Gottschling | E04B 1/6116 |
| 11,530,535 | B2 * | 12/2022 | Lai | E04B 2/7425 |
| 12,116,773 | B2 * | 10/2024 | Keller | E04C 2/46 |
| 2016/0130797 | A1 * | 5/2016 | Bruce | F24S 25/61 52/698 |
| 2017/0121961 | A1 * | 5/2017 | Hodson | E04B 1/34321 |
| 2021/0087811 | A1 * | 3/2021 | Lai | E04B 2/7405 |
| 2021/0293015 | A1 * | 9/2021 | Gottschling | E04B 1/388 |
| 2022/0178139 | A1 * | 6/2022 | Jones | E04B 1/6183 |
| 2023/0061113 | A1 * | 3/2023 | Keller | E04B 2/56 |
| 2023/0167636 | A1 * | 6/2023 | Keller | E04B 1/14 52/91.3 |
| 2024/0118590 | A1 * | 4/2024 | Fisher | G03B 15/06 |

* cited by examiner

*Primary Examiner* — Rodney Mintz

(74) *Attorney, Agent, or Firm* — Tarter Krinsky & Drogin LLP

(57) ABSTRACT

A partition system configured for building small temporary structures. The system includes a series of panels, each having cooperating connection interfaces. The connection interfaces include one or more moveable hooks on a first panel that is configured to extend into and attach a neighboring panel. The system also includes right angle frame members that allow for panels to be connected at right angles.

7 Claims, 11 Drawing Sheets

PARTITION PANEL SYSTEM

FIELD OF THE INVENTION

The invention relates to the field of partition panels, more particularly to a panel system that can form partition wall or small rooms and structures.

BACKGROUND OF THE INVENTION

There are many different needs for temporary booths, rooms, room partitions, both indoor and outdoor. Known partitions are not sufficiently sturdy, nor easy to assemble. There is therefore a need in the art for partitions formed of lightweight, yet sturdy materials and which can be easily assembled and disassembled.

SUMMARY OF THE INVENTION

Embodiments of the invention provide a partition system formed of panels having a key-locking interfaces. The panels of the invention are lightweight yet insulated allowing for the rapid assembly and disassembly of the same.

DETAILED DESCRIPTION OF THE INVENTION

Embodiments of the present invention will now be described with reference to the above-identified figures of the drawings. However, the drawings and the description herein of the invention are not intended to limit the scope of the invention. It will be understood that various modifications of the present description of the invention are possible without departing from the spirit of the invention. Also, features described herein may be omitted, additional features may be included, and/or features described herein may be combined in a manner different from the specific combinations recited herein, all without departing from the spirit of the invention.

Figure 1:
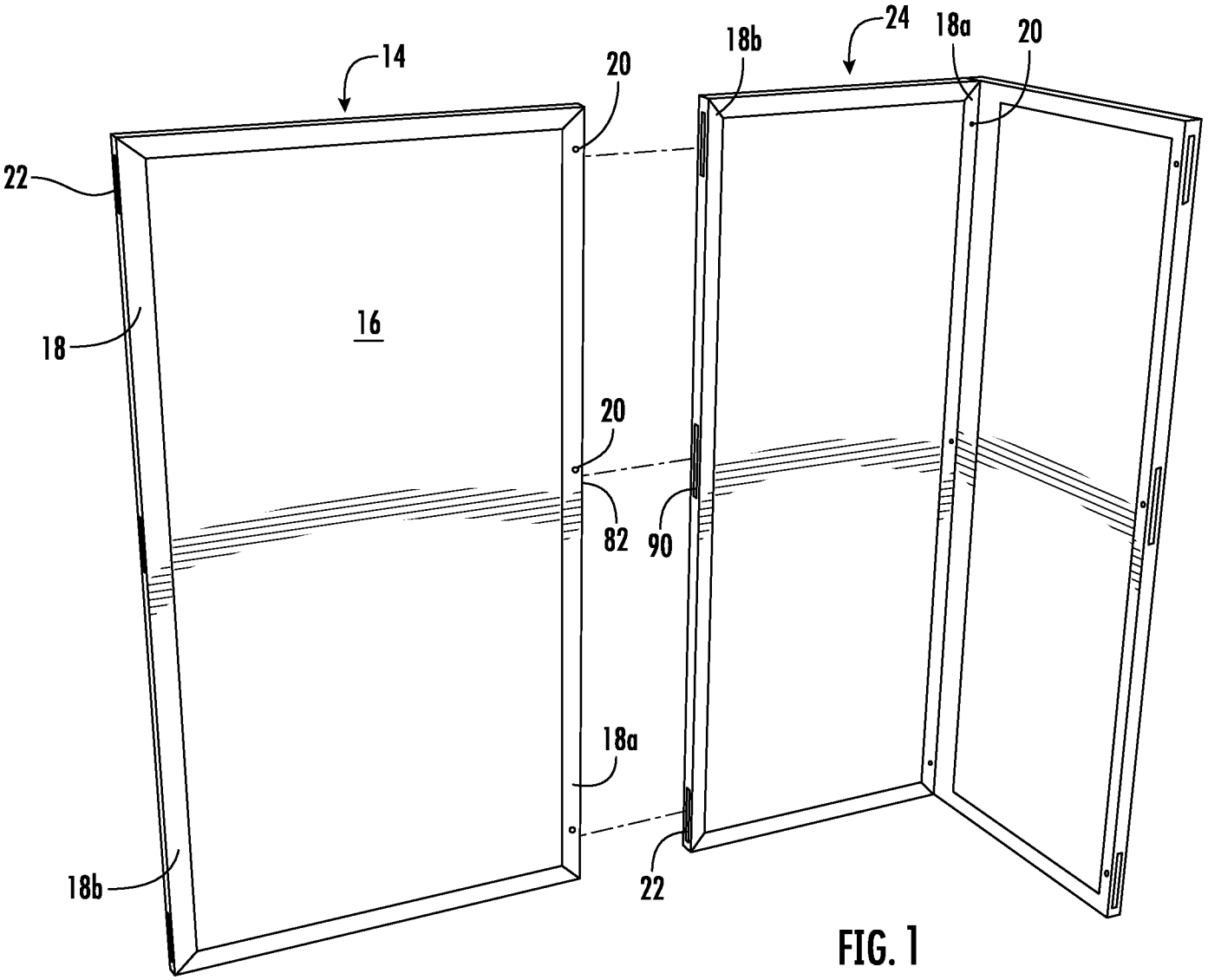
FIG. 1 is a front perspective view of a series of panels in accordance with an embodiment of the invention.

With reference to FIG. 1, a series of attachable panels are shown. Each panel is similarly constructed. For example, with reference to panel 14, an outer layer face plate 16 is shown surrounded by a frame 18 formed of right, left, upper and lower frame members. In the orientation shown, right frame member 18*a* is provided with keyholes 20 on its inward facing side, whereas a left frame member 18*b* is provided with pockets on its left side wall. Pockets 22 are configured to receive a hook emanating from a neighboring panel. As shown, panel 24 is similarly provided with pockets 22 on its left side wall, whereas, a right frame member 18*a* is provided with keyholes 20.

Figure 2:
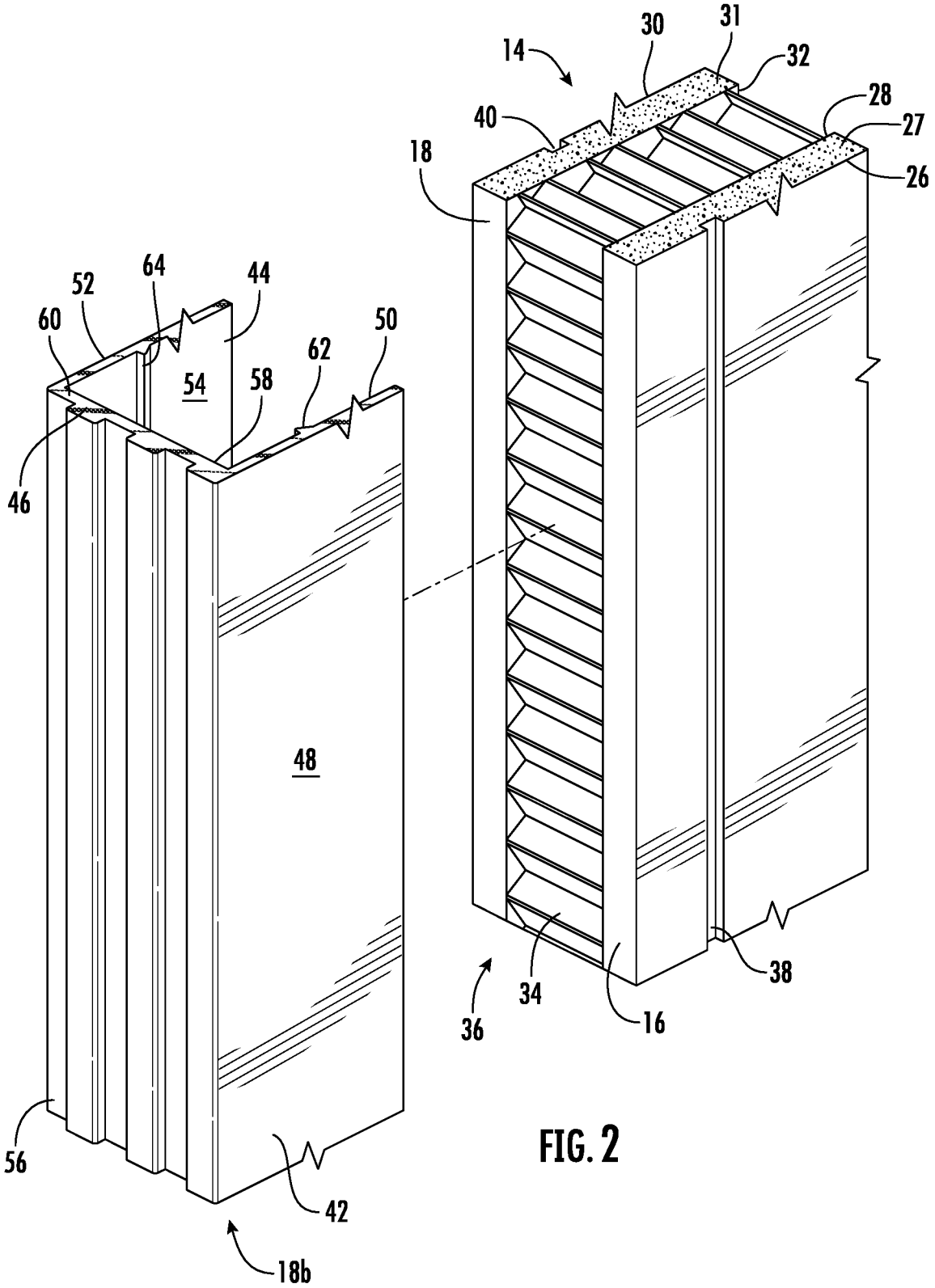
FIG. 2 is a broken-away partially exploded view of a panel and frame section in accordance with an embodiment of the invention.

FIG. 2 shows an enlarged broken-away exploded view of a panel and frame section. As shown, panel (e.g. 14) is shown formed of a first outer layer 16 (e.g. face plate), and a parallel second outer layer 18 (e.g. back plate). Face plate 16 has a first outward facing side 26 and an inward facing side 28 bridged by plate thickness 27. Back plate 18 similarly has an outward facing side 30 and inward facing side 32 bridged by thickness 31. In embodiments of the invention, a core material 34 is disposed between face plate 16 and back plate 18. In embodiments of the invention, core 34 is an insulative material such as corrugated, foam, fiberglass, cellulose or the like. In embodiments of the invention, inward facing side 28 of face plate 16 and inward facing side 32 of back plate 18 are adhered to the core material, for example, via glue or similar adhesive.

With continued reference to FIG. 2, a side aspect of face/back plates 16, 18 and core material are shown. As shown, side aspect 36 is formed is formed of side thicknesses 27, 31 of face/back plates 16, 18 and core material 34 sandwiched therebetween. It will be understood that right side aspect is similarly constructed.

In embodiments of the invention, outward facing side 26 of face plate 16 and outward facing side 30 of back plate 18 are provided with channels. In embodiments of the invention, channels are provided on respective face/back plates 16, 18 offset from the outer perimeters thereof. For example, FIG. 2 shows a channel 38 offset from the left edge of panel 14. Channel 38 is an indentation on face/back plates 16, 18 that extend into thickness 27, 31. As shown, in embodiments, a mirroring channel 40 is made in back plate 18. In an embodiment of the invention, channels 38, 40 extend the entire length of face/back plates 16, 18 or a majority thereof.

In embodiments of the invention, as mentioned, each panel is provided with a surrounding frame. With continued reference to FIG. 2, a broken away view of a left frame member 18*b* is shown. As shown, frame member 18*b* is formed of a first wing 42 and a second substantially parallel wing 44 bridged by spine 46. First wing 42 has an outer surface 48 and an inner surface 50. Second wing 44 similarly has an outside surface 52 and inside surface 54. Spine 46 has an outside surface 56 and an inside surface 58 and a thickness 60. In embodiments of the invention, a rib 62 is provided on inside surface 50 of first wing, and a mirroring rib 64 is provided on inside surface 54 of second wing. In embodiments of the invention, ribs 62, 64 are integral extensions of inner surfaces 50, 54 of first and second wings 42, 44. In embodiments of the invention, ribs 62, 64 are sized and shaped for insertion into respective channels 38, 40.

Figure 3:
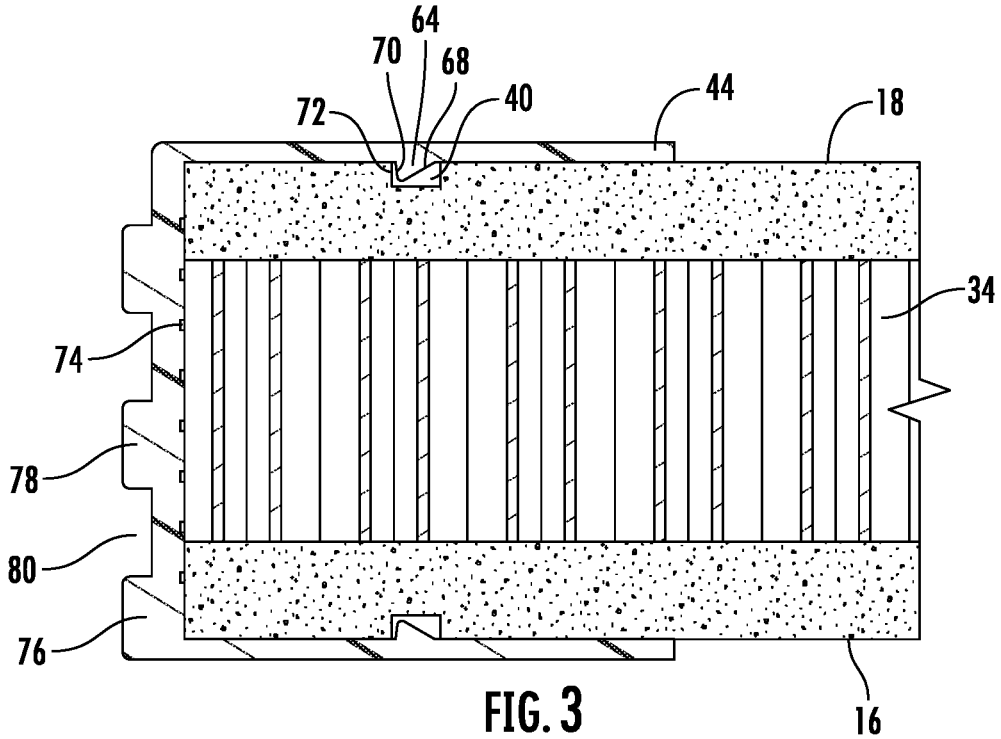
FIG. 3 is a top partial cross-sectional view of a panel and frame member in accordance with an embodiment of the invention.

As best shown in FIG. 3 channel (e.g. 64) is formed of a first angled wall 68 extending from inner surface 54 of wing 44 and a second angled wall 70. In embodiments of the invention, the second angled wall 70 is disposed at close to a 90° angle to inner surface 54 of wing 44. In embodiments of the invention second angled wall 70 is disposed between an 80° and 90° angle from inner surface 54. In this regard, second angled wall 70 is either parallel to, or substantially parallel to first side wall 72 of channel 40. A substantially mirroring construction is provided with respect to rib 62 and channel 68 of face plate 16.

Figure 4:
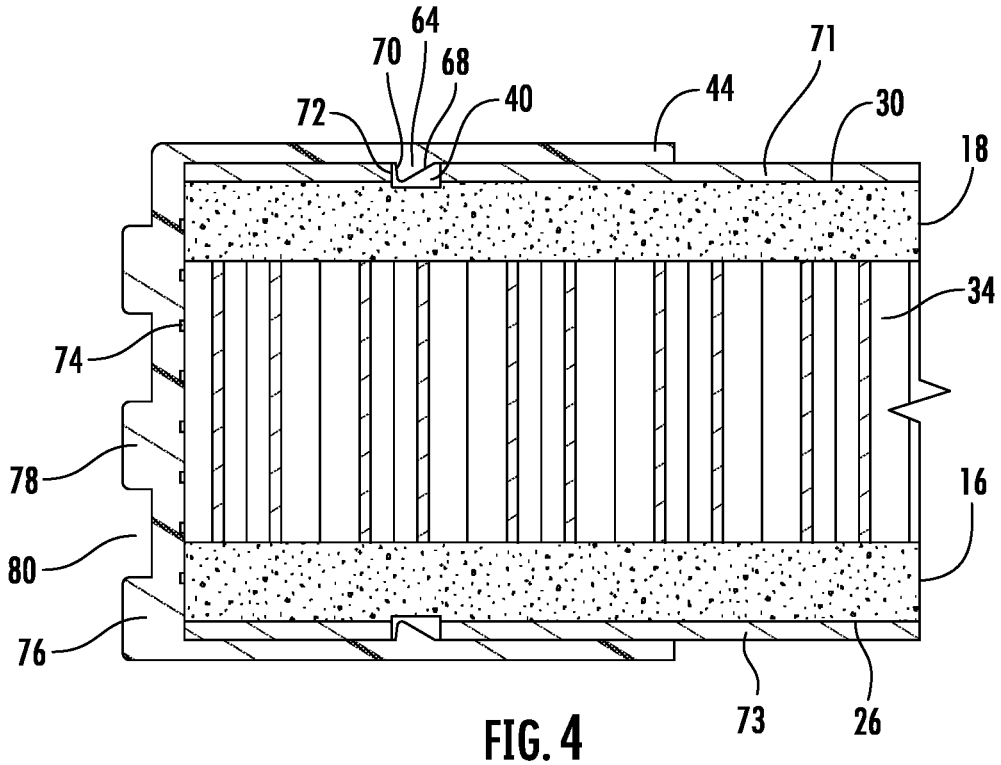
FIG. 4 is a top partial cross-sectional view of a panel and frame member in accordance with an embodiment of the invention.

In embodiments of the invention, and as shown in FIG. 4, a decorative or protective sheet may applied to cover face plate 16, back plate 18 or portions thereof. For example, as shown, a sheet 71 is applied to outward facing side 30 of back plate 18. A similar sheet 73 is applied to inward facing side 26 of face plate 16. Sheets 71, 73 may formed of any fabric or similar material such as leather, vinyl, plastic or such similar materials. In embodiments of the invention, sheets, 71, 73 are adhered to back plate 18 or front plate 16 via glue or similar adhesive. In other embodiments of the invention, sheets 71, 73 are not adhered via adhesive, rather, inside surface of respective wings (e.g. 44 and other wings of respective frame members) maintain a sheet (e.g. 71) in place.

In construction of panels, frame members (e.g. 18*b*) are forced onto panels such that ribs 62, 64 become seated in respective channel s 38, 40. For example, as shown in FIG. 3, once frame member 18*b* is applied, inner surface 50 of first wing contacts outward facing side 26 of face plate 16, inner surface 54 of second wing 44 contact outward facing side 30 back plate 18, and inside surface 58 of spine 46 contacts side aspect 36 of face/back plates 16, 18 and core material 34.

In embodiments of the invention, inside surface 58 of spine 46 is provided with a series of indentations 74 that run the length of inside surface 48. Indentations 74 provide additional surface area for glue or adhesive to bind inside surface 58 of spine to side aspect 36 of face/back plates 16, 18 and core material 34. In embodiments of the invention, glue is only used to bind inside surface 58 of spine to side aspect 36 of face/back plates 16, 18 and core material 34 and no glue is used between respective wings 42, 44 and face/back plates 16, 18. This allows for a tight connection of the frame—but also allows wings 42, 44 to move slightly away from face/back plates 16, 18 when pried by a user, for example, to add or remove a decorative sheet as described.

With continued reference to FIG. 3, in embodiments of the invention outside surface 56 of spine 46 is formed of tongue and groove elements. For example, as shown, tongue 76 is a substantially square or rectangular-shaped protrusion formed of an extension of thickness 60. Tongue 76 is shown substantially parallel to a second tongue 78. Space between tongues 76, 78 forms groove 80 that is substantially the same size and shape of tongue 76. Any number of tongues and grooves are possible in different embodiments of the invention.

Figure 5:
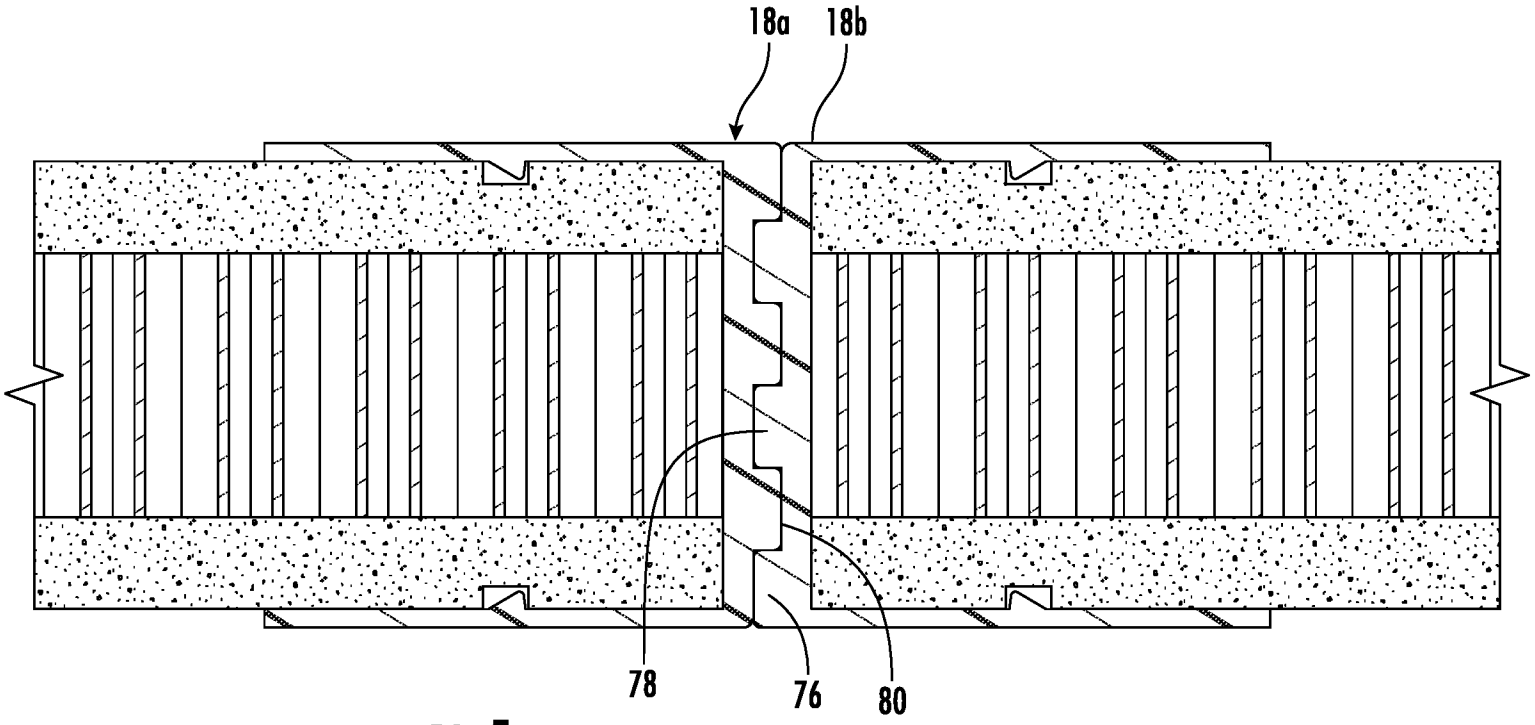
FIG. 5 is a top partial cross-sectional view of two connected panels showing interlocked frame members in accordance with an embodiment of the invention.

In embodiments of the invention, frame members are positioned on left and right sides of panels in opposing orientations. In this regard, tongues on a first panel will align with grooves on a second panel so that they may be joined in an interlocking manner. For example, FIG. 5 shows right frame member 18*a* of a first panel connected to a left frame member 18*b* on a second panel. As shown, respective tongues (e.g. 76, 78) intermesh with respective grooves (e.g. 80).

In embodiments of the invention, in addition to the intermeshing of tongues and grooves as described, panels are secured to each other by one or more retractable hooks. For example, with reference to FIG. 6A a panel (e.g. 14) is shown having a right pocket 82 or similar groove in its right side wall. In embodiments of the invention, right pocket 82 is a carved-out section of core material that is surrounded with a metal frame 84. Right pocket 82 houses a pivotable hook 86 that is connected to an axle or similar pivot. In embodiments of the invention, the axle upon which hook 86 is affixed is rotatable (clockwise and counterclockwise) by a key 88 or similar tool and is accessible via keyhole 20.

Figure 6C:
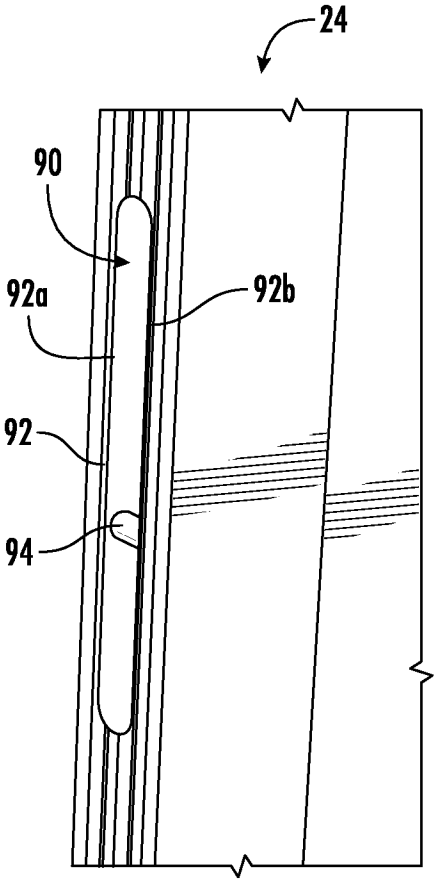
FIG. 6C is a partial view of a left side of a panel showing a bar configured to receive the hook shown in FIG. 6B in accordance with an embodiment of the invention.
Figure 6B:
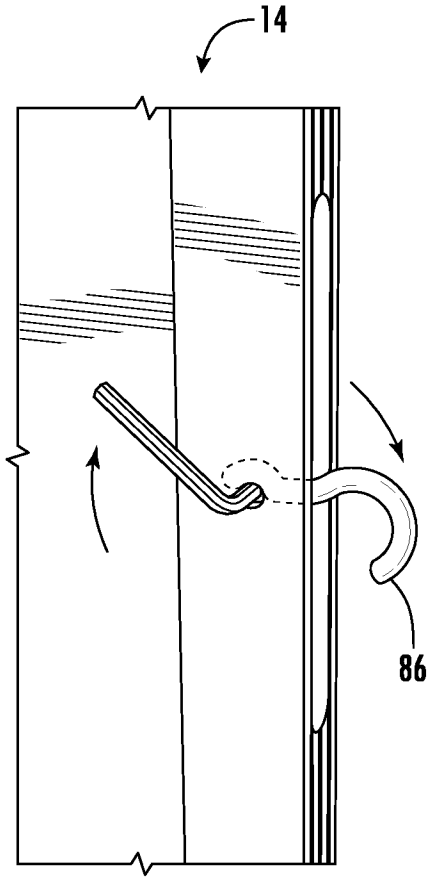
FIG. 6B is a schematic view of a key positioned in a keyhole and rotated whereby the hook is shown in a locked position.
Figure 6A:
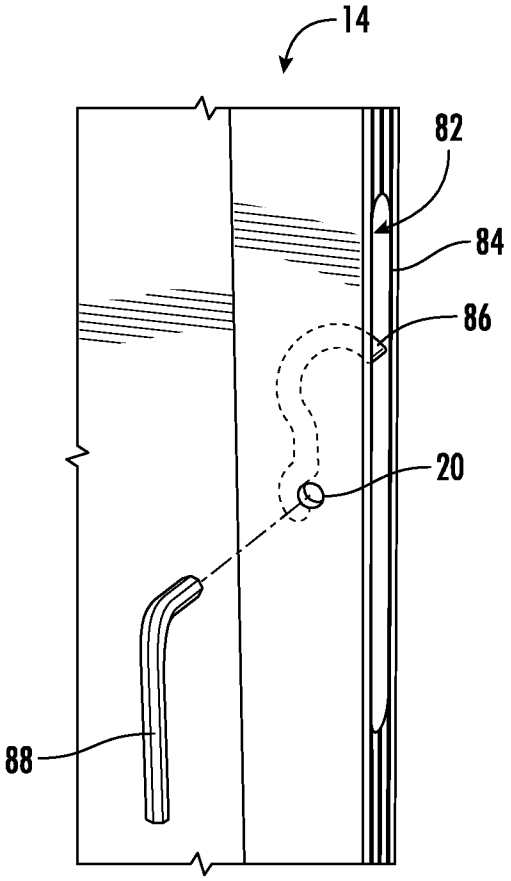
FIG. 6A is a schematic view of a key positioned to lock a panel whereby a hook is shown in a stored position in accordance with an embodiment of the invention.

As shown in FIG. 6C, left side wall of panel (e.g. 24) is provided with a left pocket 90. In embodiments of the invention, left pocket 90 is a carved-out section of core material that is surrounded with a metal frame 92. Left pocket 90 houses a bar 94 that is positioned between a first pocket wall 92*a* and second parallel pocket wall 92*b* (i.e. positioned orthogonally to hook 86). Bar 94 is a substantially cylindrical member that is sized and shaped to receive hook 86. As shown in FIG. 6B key 88 is utilized to move hook 86 from a first stowed position to a second deployed position (i.e. engaging bar 94).

Figure 7:
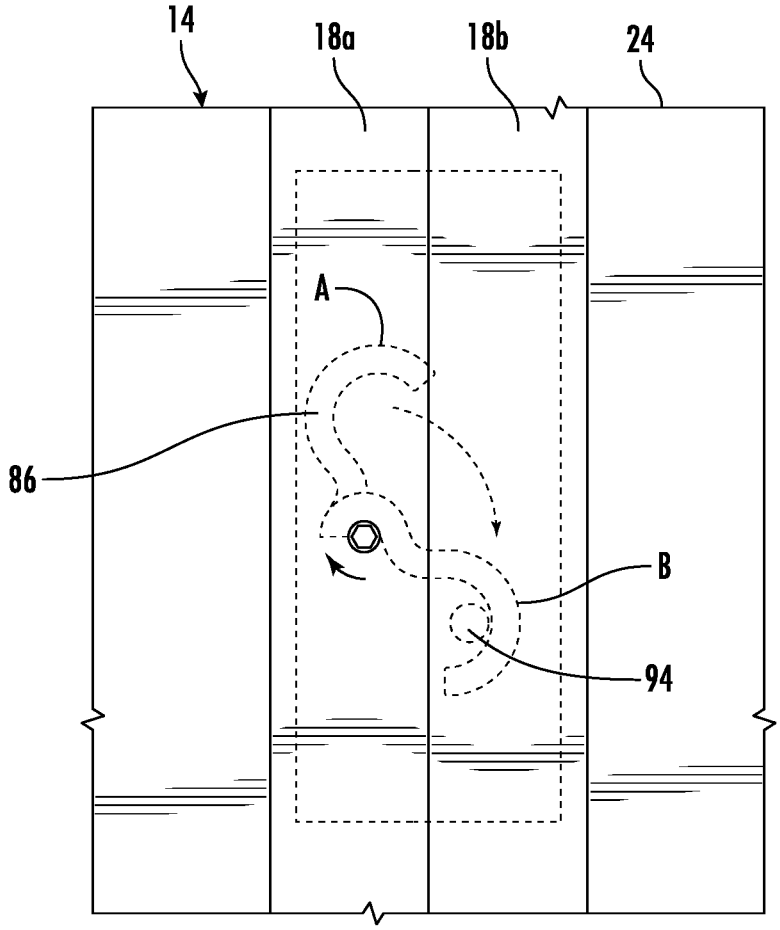
FIG. 7 is a partial front view of connected panels schematically showing a hook deployed in a locked position in accordance with an embodiment of the invention.

FIG. 7 shows a partial front view of two panels (e.g. 14, 24) where hook 86 is shown in a first stowed position A, and in a second locked position B. In the locked position, hook 86 surrounds a portion of bar 94 thereby locking two panels (e.g. 14, 24) together.

It will be understood that each panel is provided with both a right pocket housing a rotatable hook (e.g. 82) and a left pocket (e.g. 90) housing a bar or similar catch. It will be further understood that pockets could be reversed (e.g. a pocket housing a hook on left and a pocket housing a bar on left). It will be understood that each panel is provided with at least one right pocket and one left pocket (housing a hook and bar, respectively), however, other numbers of pockets are possible, for example, each side of a panel may be provided with two, three, four etc. pockets.

It will be understood that pockets provided on respective panels are positioned at substantially identical height positions to pockets on neighboring panels. For example, with reference to FIG. 1, panels 14, 24 are shown, each having three pockets on a its left side and three pockets on its right side. Each respective pocket is provided on the same level as a neighboring pocket on a neighboring panel. For example, a middle pocket (e.g. 82) on panel 14 is positioned substantially at the same height level as neighboring pocket 90. The pockets above and below the middle pockets 82, 90 are similarly configured. In this regard, when a first panel (e.g. 14) is placed side to side with a second panel (e.g. 24) all respective pockets align, providing a user one more points of connection. In the embodiment shown in FIG. 1, three points of connection are provided.

In assembling panels in accordance with embodiments of the invention, a user aligns two panels such that respective pockets align. The user then secures the panels together by rotating each of the respective hooks from the stowed position to the locked position.

In embodiments of the invention, specialized panels are provided having frame members that are configured for connecting a neighboring panel at a right angle. This allows for corner panels to be connected.

Figure 8:
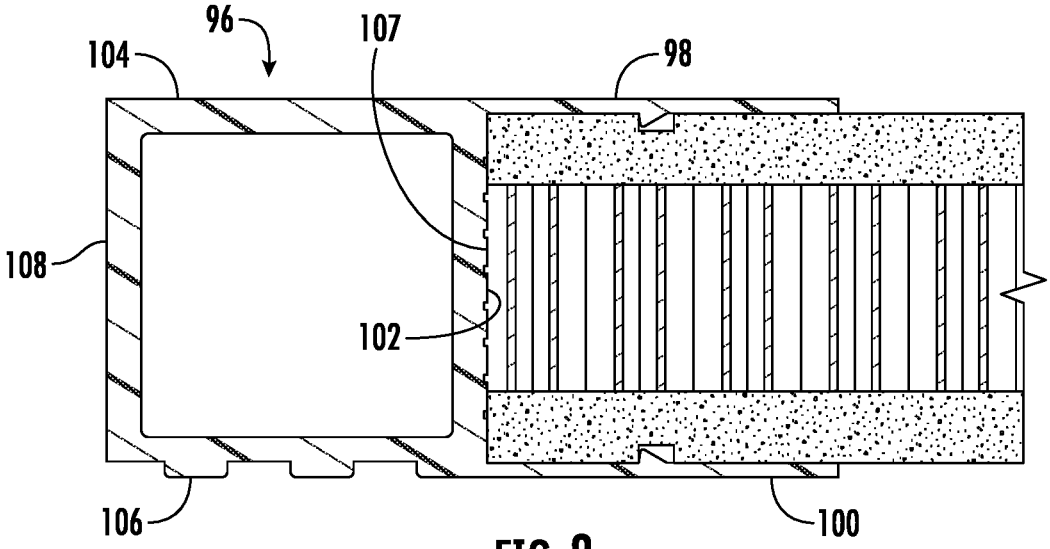
FIG. 8 is a top cross-sectional view of a corner frame member connected to a panel in accordance with an embodiment of the invention.

For example, referring to FIG. 8, a top cross-sectional view of a corner frame member 96 is shown. Corner frame member 96 is formed of a first wing 98, a substantially parallel second wing 100, and a bridging spine 102. Wing 98, 100 are configured like wings described herein (e.g. 42, 44), for example, each having inward facing ribs to grip respective channels as described. An extension wall 104 extends away from wing 98. Substantially parallel to extension wall 104 is a panel-engaging frame section 106 which substantially in line with wing 100. Extension wall 96 and panel engaging frame section 106 are bridged by a substantially orthogonal end wall 108. As shown, panel-engaging frame section 106 is positioned, substantially at a right angle to the side aspect of panel 107.

Figure 9:
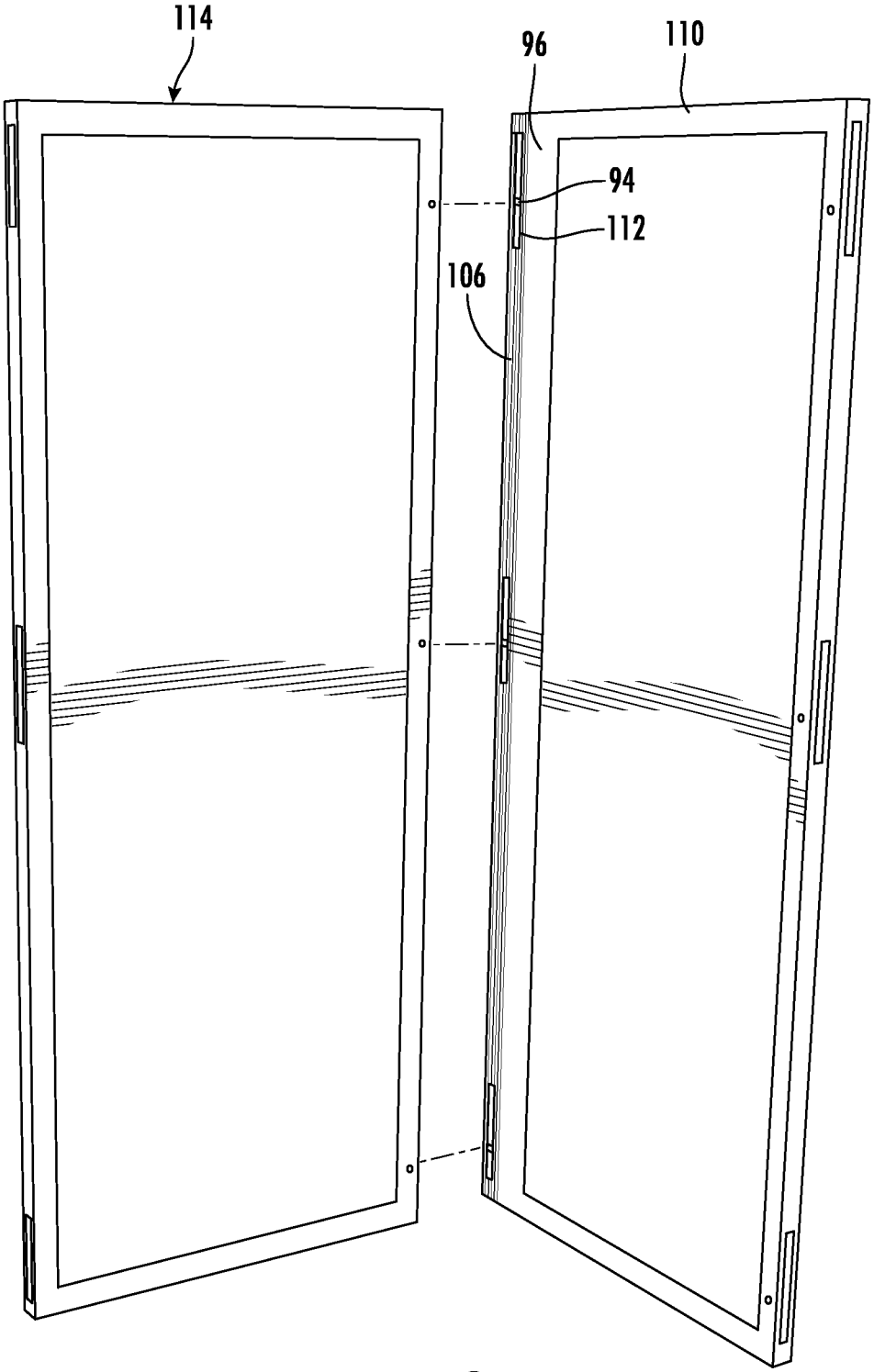
FIG. 9 is a perspective view of a panel having a corner frame positioned for connection.
Figure 10:
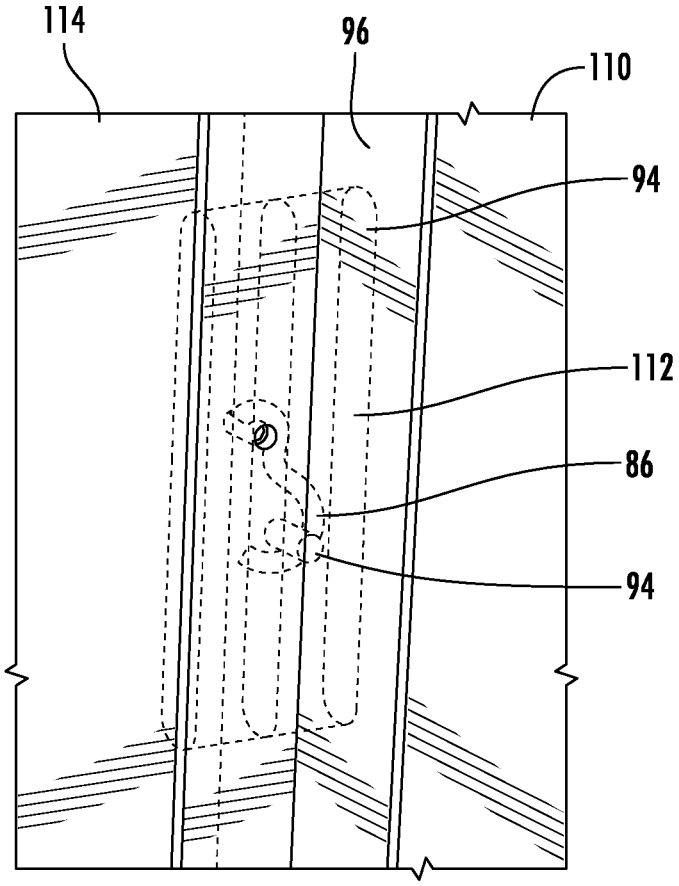
FIG. 10 partial perspective view of panels connected at a right schematically showing a hook deployed in a locked position in accordance with an embodiment of the invention.

In embodiments of the invention, panel-engaging frame section 106 is formed of tongues and grooves as described herein and also is provided with pockets containing bars, also as described herein. For example, as shown in FIG. 9, panel 110 left frame member (in the orientation shown) is a corner frame member. Panel engaging frame section 106 is shown having three pockets (e.g. 112), each having a bar 94 configured to receive corresponding hooks emanating from respective pockets on panel 114. This allows a connection of one panel (e.g. 110) at a substantial right angle to a second panel (e.g. 114).

FIG. 9 shows a perspective view of panels 110, 114 joined at a right angle. Hook 86 is shown locked around bar 94 of pocket 112.

Figure 11:
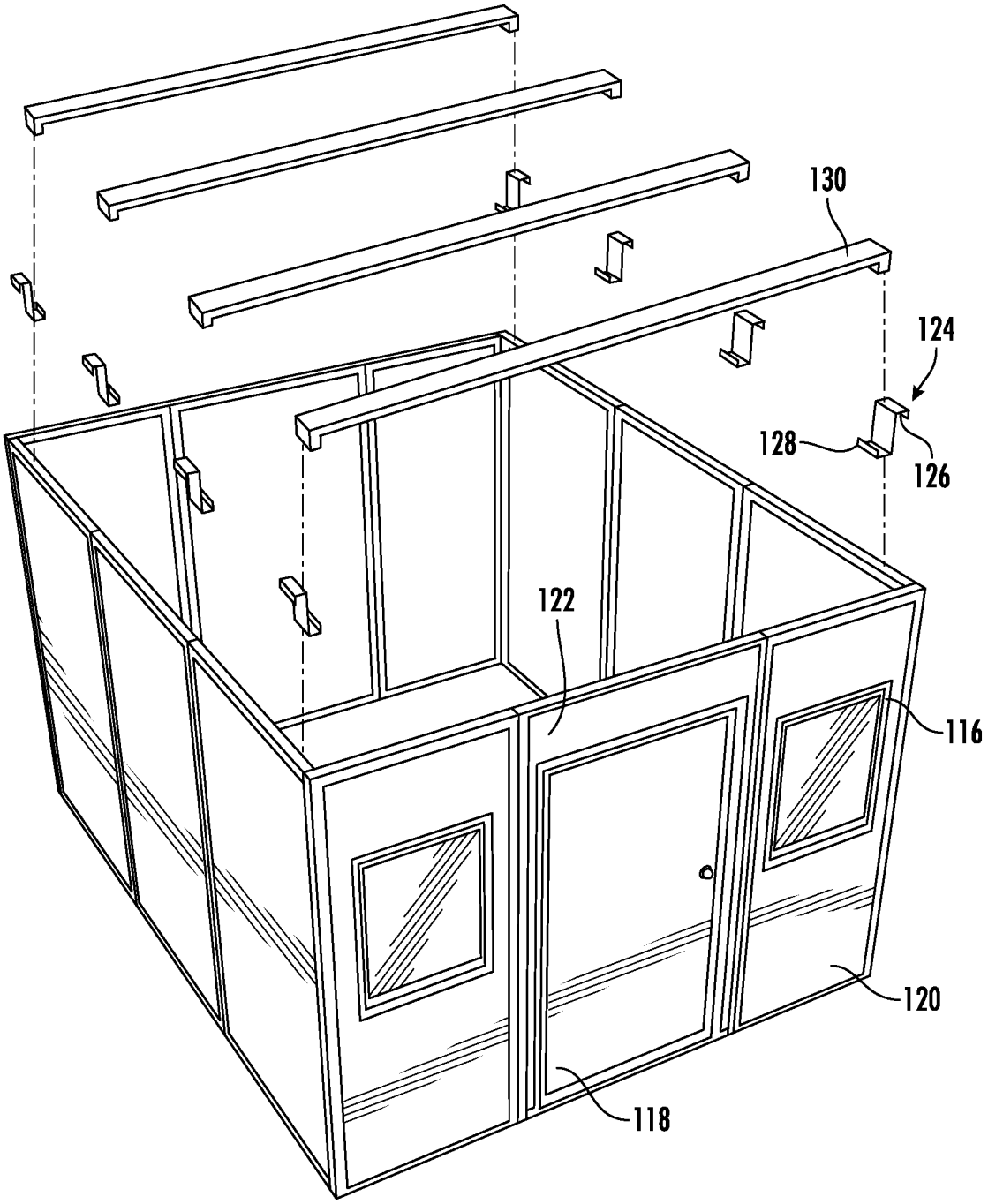
FIG. 11 is a perspective view of a walled structure formed in accordance with embodiments of the invention, with cross-beams and respective hangers show in exploded view in accordance with embodiments of the invention.

Panels of the invention may be used to form walls of any of various configurations, including straight walls, L-shaped walls, and U-shaped wall and four-walled structures. For example, FIG. 11 shows a four-walled structure formed by joined panels in accordance with embodiments of the invention.

It will be understood that panels in accordance with embodiments of the invention may be provided with windows 116, doors 118 or the like. In this regard, the outer perimeters of a panel (e.g. 120, 122) having a window/door include the connection features described herein (tongue and groove interface and respective pockets), but a central portion thereof is provided with a window/door.

Embodiments of the invention also provide a roof beam system that is used to install cross beams over an upper opening of a structure. As shown in FIG. 11, hangers 124 are provided having an upper hook 126 and a lower hook 128. Upper hooks 124 are sized and shaped to grip an upper edge of panels, whereas, lower hooks 128 are configured to connect to a cross beam 130.

Figure 12:
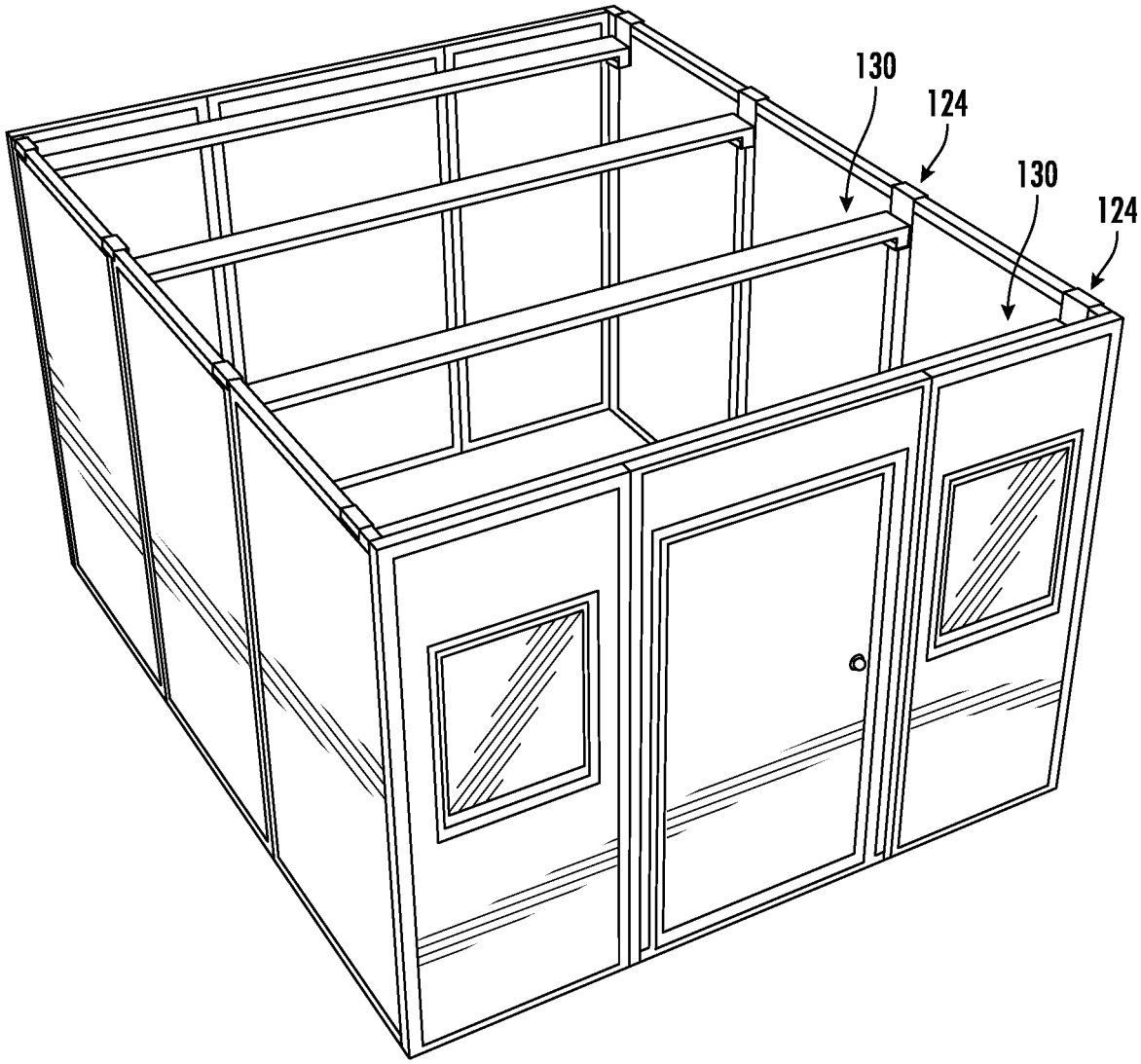
FIG. 12 is a perspective view of a walled structure formed in accordance with embodiments of the invention.
Figure 13:
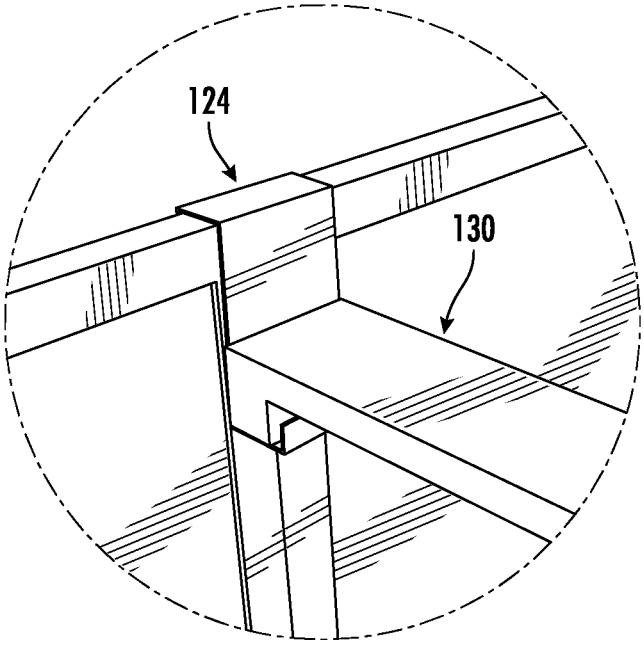
FIG. 13 is an enlarged view of a hanger joined to a panel shown supporting a crossbeam in accordance with an embodiment of the invention.

FIG. 12 shows a structure with respective cross beams 130 hung by opposing hangers 124 provided on opposite walls. It will be understood that any of various coverings may be applied atop respective cross beams in different embodiments of the invention.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A panel system, comprising:

a first panel comprising a face plate, a back plate and core material disposed between the face plate and the back plate;

the first panel having a front facing surface, a rear facing surface and a right side wall;

the first panel comprising a top frame member, a bottom frame member, a left frame member and a right frame member surrounding the first panel;

a pocket disposed on the right side wall comprising a rotatable hook;

a second panel comprising a face plate, a back plate and core material disposed between the face plate and the back plate;

the second panel having a front facing surface, a rear facing surface and a left side wall;

the second panel comprising a top frame member, a bottom frame member, a right frame member and a left frame member surrounding the second panel; and a pocket disposed on the left side wall comprising a bar configured to receive the rotatable hook, wherein each face plate comprises a first channel extending at least a portion of a length thereof, and each back plate comprises a second channel extending at least a portion of a length thereof, wherein each of the right and left frame members comprise a first wing having an inside surface and an outside surface, a second wing having an inside surface and an outside surface, and a spine having an inside surface and outside surface, the spine interconnecting the first wing and the second wing, and wherein the inside surface of the first wing comprises a first rib that is configured to be inserted in the first channel and the inside surface of the second wing comprises a second rib that is configured to be inserted into the second channel.

2. The panel system of claim 1, wherein the outside surface of the spine comprises tongues and grooves.

3. The panel system of claim 1, wherein the pocket disposed on the left side wall comprises a first pocket wall and a second pocket wall, wherein the bar is secured between the first pocket wall and the second pocket wall.

4. The panel system of claim 1, wherein the rotatable hook disposed in the pocket of the first panel is movable into the pocket disposed on the second panel.

5. The panel system of claim 1, wherein the rotatable hook is disposed on an axle.

6. The panel system of claim 5, wherein each right frame member comprises a keyhole.

7. The panel system of claim 6, wherein the axle is accessible through the keyhole.

* * * * *